US005689943A

United States Patent [19]

Wehr

[11] Patent Number: 5,689,943

[45] Date of Patent: Nov. 25, 1997

[54] APPARATUS FOR TENSIONING PACKING STRAPS AND SECURING THE ENDS TOGETHER

[75] Inventor: Hubert Wehr, Bornheim, Germany

[73] Assignee: Cyklop GmbH, Germany

[21] Appl. No.: 605,114

[22] PCT Filed: Oct. 18, 1994

[86] PCT No.: PCT/DE94/01234

§ 371 Date: Apr. 25, 1996

§ 102(e) Date: Apr. 25, 1996

[87] PCT Pub. No.: WO95/11163

PCT Pub. Date: Apr. 27, 1995

[30] Foreign Application Priority Data

Oct. 21, 1993 [DE] Germany ..... 9316072 U

[51] Int. Cl.[6] ..... B65B 67/08

[52] U.S. Cl. ..... 53/592; 53/582; 100/33 PB

[58] Field of Search ..... 53/582, 592, DIG. 2; 100/29, 32, 33 PB; 156/73.5, 495, 579, 580

[56] References Cited

U.S. PATENT DOCUMENTS

| | | | |
|---|---|---|---|
| 4,313,779 | 2/1982 | Nix | 100/33 PB |
| 4,820,363 | 4/1989 | Fischer | 53/592 X |
| 5,058,365 | 10/1991 | Kagi | 53/592 X |

FOREIGN PATENT DOCUMENTS

| | | |
|---|---|---|
| 2036802 | 2/1971 | Germany . |
| 2098164 | 11/1982 | United Kingdom . |

*Primary Examiner*—Linda Johnson
*Attorney, Agent, or Firm*—Vickers, Daniels & Young

[57] ABSTRACT

A device for tensioning and securing the ends of packing straps which are pressed by a pressure plate against a tensioning wheel. The pressure plate is designed to be lifted off of the tension wheel by the operating lever thereby allowing rotation of the tensioning wheel via an actuator element, thus enabling insertion of the strap ends into the tensioning device. This arrangement makes a special release lever unnecessary.

25 Claims, 3 Drawing Sheets

APPARATUS FOR TENSIONING PACKING STRAPS AND SECURING THE ENDS TOGETHER

The invention relates to an apparatus for tensioning and closing hooping bands, and more particularly to an apparatus for tensioning packing straps and securing the ends together which is made of plastic and is preferably designed, for hooping packages. The apparatus for tensioning and closing hoop bands preferably includes a tensioning wheel that can be turned by means of a tensioning lever, which wheel co-operates with a pressure plate for tensioning the ends of the band, and a closing device by which the two band ends can be pressed on top of one another and joined together, as well as an opening device which on being actuated lifts the closing device off the band ends and releases the pressure plate from its interaction with the tensioning wheel.

BACKGROUND OF THE INVENTION

Such apparatuses, by means of which, for example, plastic bands placed around packages can be tensioned and closed with the closing device, generally have a drive motor which receives power from a rechargeable battery or a replaceable battery. The tensioning of the hooping band takes places with the aid of the swivel lever, so that the motor is required only to operate the closing device and, therefore, uses only little current.

The swivel lever is normally arranged on the tensioning wheel axle by means of a ratchet mechanism, so that during the swivelling in one direction it turns the tensioning wheel and in this way tensions the two band ends in relation to one another. During the swivelling back of the swivel lever in the opposite direction, the tensioning wheel axle is locked and the swivel lever can swivel freely on same.

To be able to place the band ends in the apparatus prior to the tensioning or so that after the closing the apparatus can again be removed from the finished hooping, it is necessary that the pressure plate co-operating with the tensioning wheel is lifted off the latter and to also raise the closing device to such an extent that a passage is freed for the band ends. To this end the known devices have an additional venting lever, which must be actuated before the band ends are put in and after the closing has taken place, so as to put the band ends in the apparatus and to be able to take them out of same again.

Such an additional venting lever makes the apparatus unwieldy and may interfere with the actuating of the swivel lever for tensioning the band ends. It is possible that inexperienced users of the apparatus confuse the two levers. In that case it may happen that due to an unintentional actuating of the venting lever already tensioned hooping bands suddenly lose their pre-stress again and shoot out of the device, and in doing so injure the user of the apparatus.

SUMMARY OF THE INVENTION

It is the object of the invention to avoid these disadvantages and to create an apparatus for tensioning and closing hooping bands, which is easy to handle and can be operated easily and safely.

This object is achieved by the invention in that between the swivel lever and the opening device an actuating element is provided, which during the swivelling of the swivel lever in a specific area engages with an actuating area for actuating the opening device.

This construction has the advantage that an additional venting lever can be dispensed with, as the swivel lever serves to tension the hooping bands as well as to lift off the pressure plate and the closing device after the closing has taken place or before the band ends are put in.

The apparatus, therefore, has only one lever for tensioning the band ends as well as for actuating the opening device, and as a result thereof is very easy to manage and particularly easy and safe to operate. The user of the apparatus, to carry out the tensioning and opening, need not change from one lever to the other, so that operating mistakes due to him confusing the levers are excluded. It is particularly expedient when the actuating element is a stop pin arranged on the swivel lever and the actuating area is provided on a lever element coupled to the opening device. Such a construction can be produced in a particularly simple and economical manner and ensures reliable operation of the apparatus.

The lever element is preferably arranged on the rotation shaft of the tensioning wheel, which is particularly space-saving. It is particularly advantageous when the stop pin is connected to a pawl arranged axially movable on the swivel lever, which pawl co-operates with a ratchet wheel connected to the tensioning wheel axle, and when the lever element has a curved area for moving the stop pin.

With this embodiment the stop pin lifts the pawl out of its engagement with the ratchet wheel when the latter, during the swivelling back of the swivel lever, gets to the curved area on the lever element and slides along same, before it comes in contact with the actuating area. When the lever, after lifting off the pressure plate and putting the band ends between the pressure plate and tensioning wheel, is again swivelled in the tensioning direction, the pawl will only engage into the ratchet wheel to turn the tensioning wheel when the stop pin no longer slides over the curved area. This ensures that the pressure plate always presses completely and with the full pressing force against the tensioning roller before the latter can be mined. This securely avoids a slipping through of a band end between the tensioning roller and pressure plate.

The lever element and the opening device are preferably coupled by a transmission gear. This makes it possible to obtain also with small swivelling movements of the lever, sufficiently large adjusting movements on the opening device to lift the pressure plate off the tensioning wheel or to lift the closing device off the band ends to such an extent that the band ends can easily be put in and the device can easily be removed from the finished hooping.

The transmission gear expediently has a drive wheel connected rotationally rigid to the lever element and a driven wheel fastened on a drive shaft, which wheels may be coupled by an endless drive chain. Such a construction is particularly space-saving. The drive chain, which preferably may be a flat link chain, is inexpensive and can easily be installed. It is also possible to couple the drive wheel and the driven wheel by a transmission gear-wheel instead of by a chain.

The opening device advantageously has a swivel body arranged on the driven shaft, which has a pressure area for an actuating lever to lift off the closing device and a stop element to lift the pressure plate off the tensioning wheel. By the pressure area on the one hand and the stop element on the other hand, the pressure plate and closing device can be raised independently of one another. In this way it is possible, after closing the band ends, to first swivel the swivel lever only so far that only the closing device is lifted off the band ends by the actuating tappet actuated by the pressure area. Only when the lever is swivelled still further, will the stop element become operative and lift the pressure plate off the tensioning wheel.

The pressure area is preferably arranged on a pressure body and curved around an axis which extends parallel to the drive shaft. Here the pressure body is connected to the swivel body by a damping element. The curvature of the pressure area ensures that the movement transmitted by the swivel lever to the swivel body is passed into the actuating tappet without transverse forces. The damping element between the pressure body and swivel body, which may consist of a hard rubber part, prevents the actuating tappet from being pushed too far forward when the swivel lever is swivelled farther than is required to lift off the closing device and the pressure plate.

The swivel body is expediently spring-loaded, as a result of which, during the swivelling of the swivel lever in the tensioning direction, it will automatically swivel back into its starting position, and in doing so, by way of the gear, it will also reset the lever element. The spring which returns the swivel body to its starting position may, for example, be a torsion spring. A particularly simple construction is obtained when a spring element acts on the actuating tappet and presses same under pre-stress against the pressure area on the swivel body.

In summary, there is provided an apparatus for tensioning and closing hooping bands for hooping packages, comprising a tensioning wheel that can be turned by means of a tensioning lever, which wheel co-operates with a pressure plate for tensioning the ends of the band, and a closing device by which the two band ends can be pressed on top of one another and joined together, as well as an opening device which, on being actuated, lifts the closing device off the band ends and releases the pressure plate from its interaction with the tensioning wheel, wherein between the swivel lever and the opening device an actuating element is provided, which during the swivelling of the swivel lever in a specific area engages with an actuating area for actuating the opening device. The actuating element is preferably a stop pin arranged on the swivel lever. The actuating area is preferably arranged on a lever element coupled to the opening device. The lever element is preferably arranged rotatably on a rotation shaft of the tensioning wheel. The stop pin is preferably connected to a pawl arranged axially movable on the swivel level which pawl co-operates with a ratchet wheel connected to the tensioning wheel rotation shaft and wherein the lever element has a curved area for moving the stop pin. The lever element and the opening device are preferably coupled by a transmission gear unit. The transmission gear unit preferably has a drive wheel connected in a rotationally rigid manner to the lever element and a driven wheel fastened on a drive shaft. The drive wheel and the driven wheel are preferably coupled by an endless drive chain by a transmission gear wheel. The opening device preferably includes a swivel body arranged on the drive shaft, which has a pressure area for an actuating tappet for lifting off the closing device and with a stop element for lifting the pressure plate off the tensioning wheel. The pressure area is preferably arranged on a pressure body and is curved around an axis which extends parallel to the drive shaft and wherein the pressure body is connected to the swivel body by way of a damping element. The swivel body is preferably spring-loaded. The spring element preferably engages with the actuating tappet and presses same under pre-stress against the pressure area on the swivel body.

These and other advantages will become apparent to those skilled in the art upon reading and following the description taken together with the accompanied drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE PREFERRED EMBODIMENT

Figure 1:
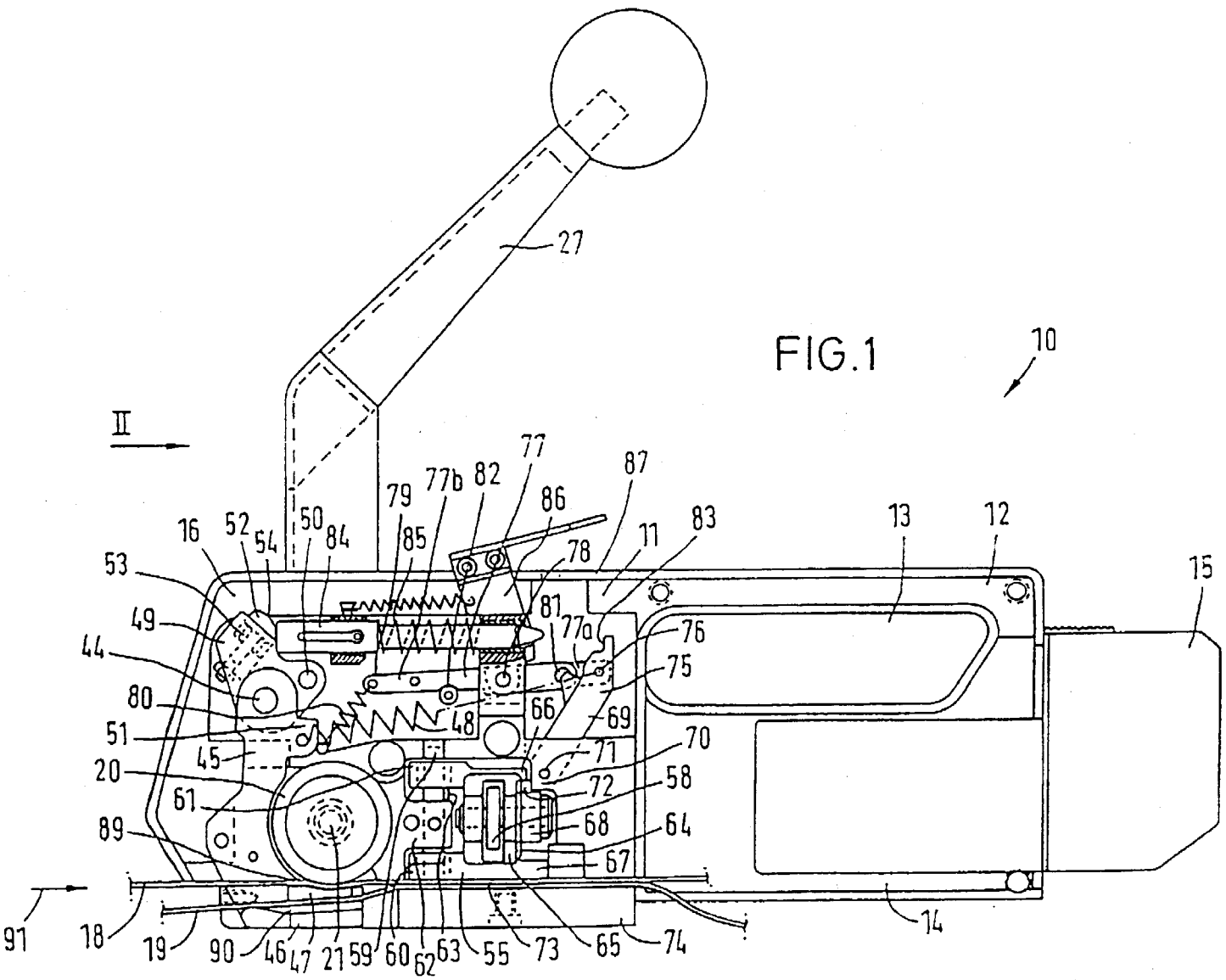
FIG. 1 shows an apparatus according to the invention in a side view with the housing removed.
Figure 2:
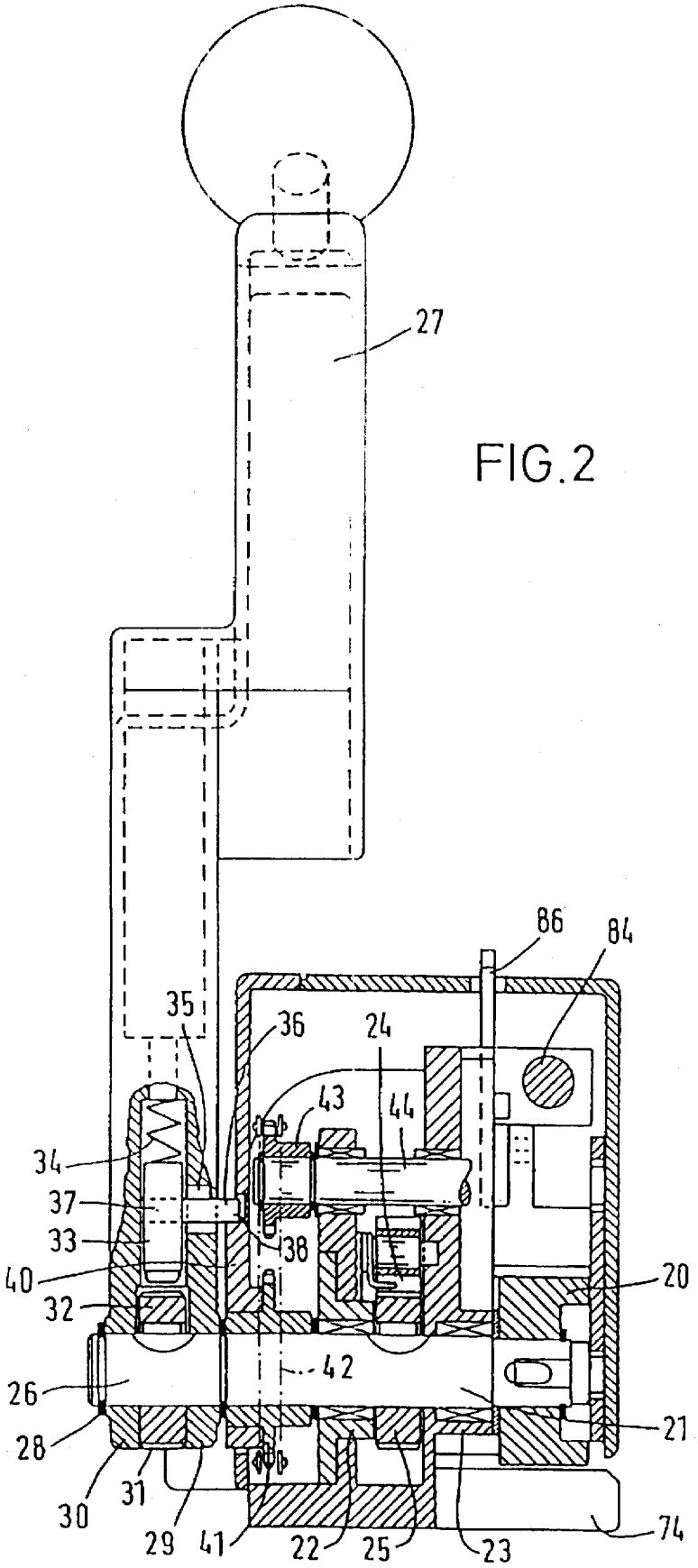
FIG. 2 shows the subject of FIG. 1 in a view in the direction II according to FIG. 1 and partly in section.

Referring now to the drawings, wherein the showings are for the purpose of illustrating the preferred embodiments of the invention only and not for the purpose of limiting the same, FIG. 1 illustrates an apparatus 10 for tensioning and closing plastic bands, comprising a housing 11, the rear housing part 12 of which has a hand grip 13 and a push-in part 14 for a replaceable or a rechargeable battery 15.

Accommodated in the front housing part 16 are the units for tensioning and closing a hooping band placed around a package, as well as a drive motor 17 and not illustrated electric switching and control elements.

To tension the band ends 18, 19 of the hooping band, the apparatus 10 has a tensioning wheel 20, which is connected in a form-locking manner to a rotation shaft 21, which is mounted rotatably, transversely to the longitudinal direction of the apparatus, in two bearing blocks 22, 23 in the front housing part 16. Between the beating blocks 22, 23 a locking mechanism 24 is provided, which co-operates with a ratchet wheel 25 positioned on the shaft and ensures that the rotation shaft 21 with the tensioning wheel 20 can be rotated in only one direction.

The end 26 of the rotation shaft 21 positioned opposite the tensioning wheel 20 protrudes out of the housing 11. A swivel lever 27 is put onto this end 26 and secured with a retaining ring 28. The swivel lever 27 has an inside bearing eye 29 and an outside bearing eye 30. In the recess 31 between same a ratchet wheel 32 is mounted rotationally rigid on the rotation shaft, which ratchet wheel 32 co-operates with a pawl 33, which is arranged in the swivel lever 27 and is pressed against the ratchet wheel by the action of a coil spring 34. The pawl 33 is shaped in such a way that it permits the swivel lever 27 to swivel on the rotation shaft 21 in the direction in which the rotation shaft 21 is locked by the locking mechanism 24.

On its side facing the housing 11, the swivel lever has a slot 35 extending in the direction of the pawl 33, through which a cylindrical stop pin 36 is pushed into a transverse bore 37 in the pawl 33. The stop pin 36 forms an actuating element 38 for a hook-shaped actuating area 39 on a lever element 40 which is connected to a drive chain wheel 41, which is mounted rotating freely on the rotation shaft 21.

The drive chain wheel 41 is coupled by a drive chain 42 to a driven chain wheel 43, which is connected in a rotationally rigid manner to a driven shaft 44 mounted in the housing 11 parallel to the rotation shaft 21. On the end of the driven shaft 44 facing away from the driven chain wheel 43, a bracket 45 is arranged in a swivelling manner, to the bottom end of which a projecting pressure plate 46 is fastened. Above the pressure plate 46 a distance holder 47 is fastened to the bracket 45 in such a way that it can be moved parallel to the pressure plate.

The bracket is pulled in the direction of the tensioning wheel 20 by a strong tension spring 48, so that the pressure plate 46 presses from below via the distance holder 47 against the tensioning wheel 20. With this the one band end 18 is clamped between the tensioning wheel and the distance holder 47 and the other band end 19 between the distance holder 47 and the pressure plate 46.

Also connected to the driven shaft 44 in a rotationally rigid manner is a swivel body 49, on which a stop element 50 is provided which can engage with a projecting hook 51 on the bracket 45. Also fastened to the swivel body 49, with the interposition of a damping element 53 of hard rubber, is a pressure body 52, which has a curved area 54 with an axis of curvature which extends parallel to the driven shaft 44.

The apparatus's device for closing the hooping band consists essentially of a movable friction cheek 55, which can be swivelled to and fro around a vertical axle 59 by the drive motor 17 via a belt drive 56 and a crank shaft 57 with connecting rod 58.

As can be noted from FIG. 1, the movable friction cheek 55 is in longitudinal section roughly H-shaped and with its two front legs 60, 61 engages over a bearing block 62 in the housing 11, in which also the vertical axle 59 is positioned, around which the friction cheek 55 cannot only swivel, but along the longitudinal direction of which it can also move up and down within certain limits. To this end, sufficient play 63 is provided between the bearing block 62 on the one side and the front legs 60, 61 of the friction cheek 55 of the other side. At the rear surface 64 of the web 65 of the H-shaped friction cheek 55, between the two rear legs 66 and 67, a pressure roller 68 consisting of a ball mounted ring is mounted rotatably. A pressure lever 69, which at its bottom end 70 is mounted swivelling around a pivot 71 in the housing 11, acts on this pressure roller 68. The pressure lever 69 furthermore has at its bottom end a lug 72 projecting towards the front, with which it engages under the top rear leg 66 projecting beyond the rear surface 64, and holds the movable friction cheek 55 in its upper inoperative position, in which a band guiding space 73 is left open between the same and an abutment plate 74 and it does not act on the band ends 18 and 19 positioned in between.

At its upper end 75 the pressure lever 69 is linked by a hinge pin 76 to the rear part **77*a* of an articulated lever 77, the front part 77*b* of which is mounted swivelling on a horizontal swivel axle 78 in the housing 11 and projects towards the front beyond this swivel axle 78. The front end 79 of the articulated lever 77 is engaged by a tension spring 80, which is fastened to the housing and serves to pull the front end 79 of the articulated lever 77 downwards and as a result thereof swivels the articulated lever 77 around its swivel axle 78 in an anti-clockwise direction. When doing so, the front part 77*b* of the articulated lever 77 butts against a stop 82. In this position the articulated lever 77 acts as a rigid stay which holds the pressure lever 69 in a position in which the friction cheek 55 is lifted off the abutment plate 74**.

The hinge pin 76 of the pressure lever 69 is engaged by the strong tension spring 48 fastened to the bracket 45. Above the hinge pin 76 the pressure lever 69 has a switching area 83 for an actuating tappet 84, which is mounted in the housing 11 in a longitudinally movable manner and is pressed by a pressure spring 85 against the pressure area 54 on the swivel body 49.

To switch on the closing device and lower the friction cheek 55 onto the band ends 18, 19, a release lever 86 is provided on the swivel axle 78, which lever extends through the top housing cover 87 and when actuated by way of a not illustrated projection presses on the front part **77*b* of the articulated lever 77** and swivels same in a clockwise direction.

Figure 3:
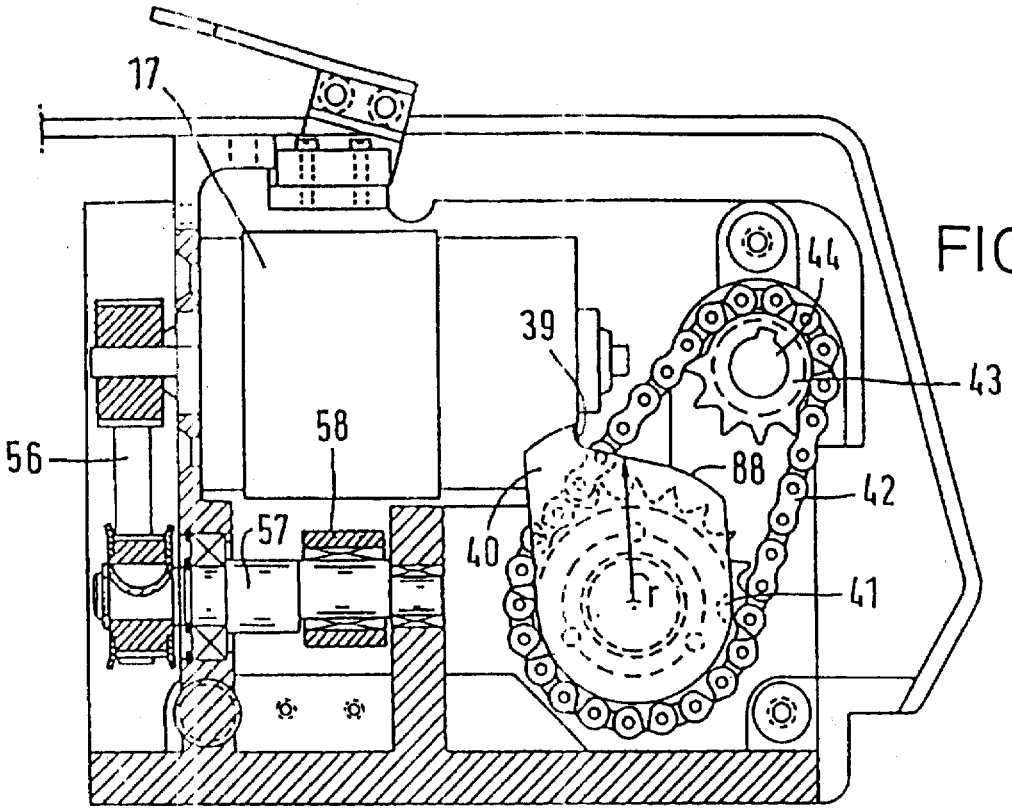
FIG. 3 shows the apparatus according to the invention in a side view opposite to that of FIG. 1, without swivel lever, also partly in section.

As can be noted from FIG. 3, the lever element 40 has a curved area 88, the distance r from the axis of the rotation shaft 21 increases in the direction of the actuating area 39.

The mode of operation of the apparatus is as follows:

To put the band ends 18, 19 around the here not further illustrated package, the swivel lever 27 is swivelled in the direction of the hand grip 13. In this swivelling direction the pawl 33 and the ratchet wheel 32 permit the lever 27 to swivel freely, whilst the rotation shaft 21 is locked in this direction of rotation by the locking mechanism 24.

During the swivelling of the swivel lever 27, the stop pin 36 comes onto the curved area 88 of the lever element 40 and as a result lifts the pawl 33, against the action of the coil spring 34, off the ratchet wheel 32. This ensures that the pawl 33 and ratchet wheel 32 are disengaged when the stop pin 36 rests against the curved area 88 of the lever element 40.

When the swivel lever 27 is swivelled further in the direction of the hand grip 13, the stop pin 36 engages with the hook-shaped actuating area 39 on the lever element 40 and turns same together with the drive chain wheel 41 in the counterclockwise direction on the stationary rotation shaft 21 (FIG. 3). As a result thereof, by way of the chain drive 42, the driven chain wheel 43 together with the driven shaft 44 in the housing is turned and swivels the swivel body 49, during which the pressure area 54 provided on the pressure body 52 presses against the front end of the actuating tappet 84 and moves same against the action of the pressure spring 85 in the longitudinal direction in the housing 11 in the direction of the switching area 83 on the pressure lever 69 (FIG. 1). When the lever 27 is swivelled further, the stop element 50 provided on the swivel body 49 comes in contact with the hook 51 on the bracket 45 and swivels same a short way in the clockwise direction, due to which the pressure plate 46 and the distance holder 47 are lifted off the tensioning wheel 20 and free an upper clamping space 89 between the tensioning wheel 20 and distance holder 47 and a lower clamping space 90 between the distance holder 47 and pressure plate 46, into which the band ends 18 and 19 can be inserted.

Next one lets go of the swivel lever 27, as a result of which the actuating tappet 84 is pushed back automatically by the pressure spring 85 and swivels the swivel body 49 into its starting position. The pressure plate 46 and the distance holder 47 are pulled against the tensioning wheel by the strong tension spring 48 acting on the bracket 45, and clamp the band ends 18, 19 between them and the tensioning wheel 20.

To tension the band ends 18 and 19 in relation to one another, the swivel lever 227 must first be swivelled forward so far until the stop pin 36 no longer rests on the curved area 88, and the pawl 33 can engage in the ratchet wheel 32. Only then is the lever 27 in form-locking connection with the rotation shaft 21 and will turn the tensioning wheel 20, which pulls the upper band end 18 of the hooping band through the apparatus in the direction of the arrow 91 and places the hooping under tension. When the required tension cannot be obtained by moving the lever 27 forward once, the swivel lever 27 can again be swivelled back some way, during which the locking mechanism 24 holds the rotation shaft 21 of the tensioning wheel 20 in position.

When the desired band tension has been obtained after swivelling the lever 27 forward and back once or a few times, the user of the apparatus can actuate the release lever 86. By doing so the joint 81 of the articulated lever 77 gives way towards the bottom, so that the pressure lever 69 loses its support at the upper end 75 and, under the effect of the strong tension spring 48, is swivelled forward in the counter-clockwise direction. As a result thereof the lug 72 releases the movable friction cheek 55 and the bottom end 70 of the pressure lever 69 presses on the pressure roller 68 mounted on the face 64 of the friction cheek 55, due to which the friction cheek 55 is pressed onto the band ends 18, 19 positioned in the band guiding space. At the same time the drive motor 17 is switched on by a not illustrated switch and moves the friction cheek to and fro, so that it takes along the upper band end 18 and moves it over the bottom band end. In doing so, friction heat is produced in the known manner, as a result of which the surfaces of the band ends rubbing against one another become soft and fuse together.

The drive motor 17 for the friction cheek 55 is controlled by a timing mechanism which ensures that the motor moves the friction cheek 55 to and fro so long until the friction heat required for the fusing has been produced between the band ends 18, 19. After the timer has expired, the drive motor 17 is switched off and the friction cheek 55 stands still and presses the band ends 18, 19 firmly against one another, so that they fuse together in the heated area and are joined together in a tension-resistant manner.

To remove the apparatus 10 from the closed hooping, the swivel lever 27 is again swivelled in the direction of the hand grip 13, as already described. When doing so, the actuating tappet 84 presses against the switching area 83 on the pressure lever 69 and presses same backwards in the clockwise direction, so that the projecting lug 72 at the bottom end 70 of the pressure lever engages under the top rear leg 66 of the friction cheek 55 and lifts same upwards, in this way freeing the fused band ends. When doing so, the articulated lever 77 is moved back into its starting position illustrated in FIG. 1 and held in this position against the stop 82 by the tension spring 80, as a result of which the friction cheek 55 is securely held in its raised position.

Figure 4:
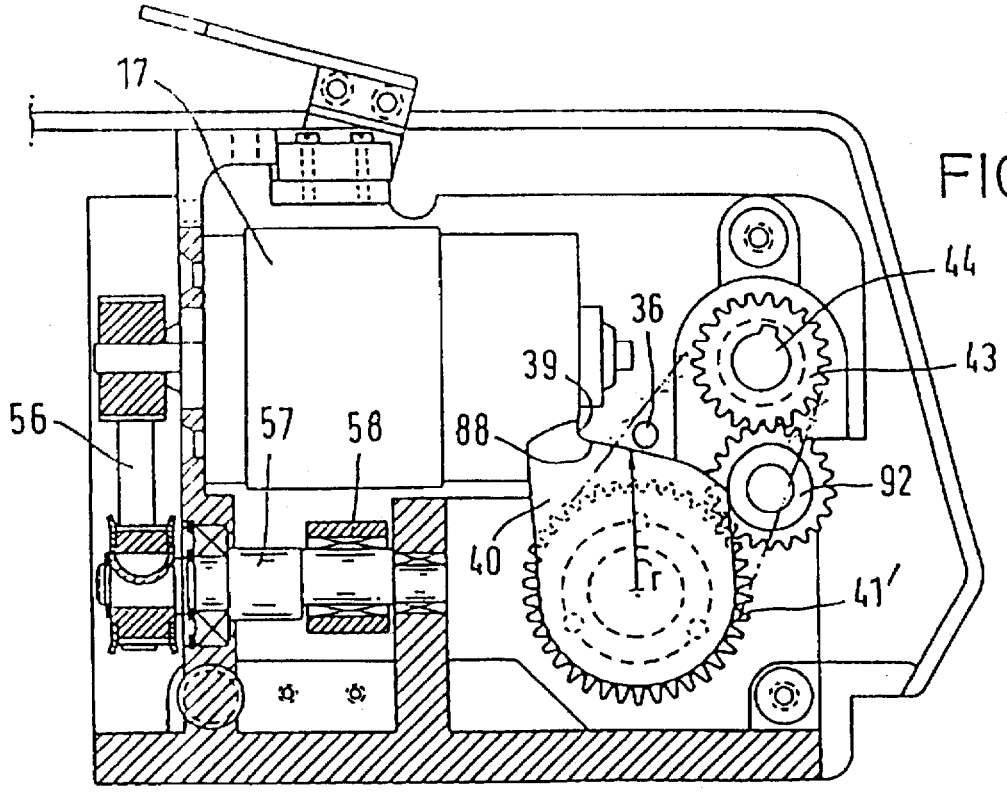
FIG. 4 shows another embodiment of the invention in a view corresponding to that of FIG. 3.

The invention is not limited to the described exemplified embodiment, but several modifications and additional features are possible without going beyond the flamework of the invention. Thus it is possible, for example, to couple a drive gear-wheel 41' and a driven gear-wheel 43' by a transmission gear-wheel 92, as illustrated in FIG. 4. It is furthermore conceivable to also couple the release lever 86 to the swivel lever 27 in such a way that during the swivelling of the lever into a specific angle position, the friction cheek is automatically lowered and the drive motor switched on. It is also conceivable to use other closing devices, e.g. for closing metal bands.

The invention has been described with reference to a preferred embodiment and alternates thereof. It is believed that many modifications and alterations to the embodiment disclosed will readily suggest themselves to those skilled in the art upon reading and understanding the detailed description of the invention. It is intended to include all such modifications and alterations insofar as they come within the scope of the present invention.

I claim:

1. An apparatus for tensioning and securing together two sections of a packing strap comprising a tensioning wheel, a swivel lever, pressure plate means which cooperates with said tensioning wheel for selectively providing tension to the sections of said packing strap, closing means for pressing together and securing together said sections of said packing strap, and opening means for lifting said closing means from said sections of said packing strap and releasing the tension on said sections by said pressure plate means, said pressure plate means including a distance holder and a pressure plate, said distance holder engaging one of said strap sections and said pressure plate engaging said other strap section when providing tension to said packing strap, said swivel lever connected to said tensioning wheel by connector means for selectively rotating said tensioning wheel, and said swivel lever includes an actuator for selectively engaging said opening means on an actuator area wherein said actuator upon engagement with said opening means at said actuation area causing said opening means to disengage said closing means and to disengage said pressure plate means from said sections of said packing strap.

2. An apparatus as defined in claim 1, wherein said actuator includes a stop pin connected to said swivel lever, and said actuation area is positioned on a lever element which is rotatably coupled to a rotation shaft which is connected to said tensioning wheel.

3. An apparatus as defined in claim 2, wherein said stop pin is connected to a pawl, said pawl axially movable in said swivel lever for selectively engaging said rotation shaft of said tensioning wheel.

4. An apparatus as defined in claim 3, wherein said swivel lever including a ratchet wheel which engages said rotation shaft, and said pawl in selective engagement with said ratchet wheel for controllably rotating said rotation shaft upon movement of said swivel lever.

5. An apparatus as defined in claim 2, wherein said lever element is connected to said opening means by a gear arrangement.

6. An apparatus as defined in claim 3, wherein said lever element is connected to said opening means by a gear arrangement.

7. An apparatus as defined in claim 4, wherein said lever element is connected to said opening means by a gear arrangement.

8. An apparatus for tensioning and securing together a packing strap comprising a tensioning wheel, a swivel lever, pressure plate means which cooperates with said tensioning wheel for selectively providing tension to the ends of said packing strap, closing means for pressing together and securing together said ends of said packing strap, and opening means for lifting said closing means from said ends of said packing strap and releasing the tension on said ends by said pressure plate means, said swivel lever connected to said tensioning wheel connector means for selectively rotating said tensioning wheel, and said swivel lever includes an actuator for selectively engaging said opening means on an actuator area wherein said actuator upon engagement with said opening means at said actuation area causing said opening means to disengage said closing means and to disengage said pressure plate means from said ends of said packing strap, said actuator includes a stop pin connected to said swivel lever, and said actuation area is positioned on a lever element which is rotatably coupled to a rotation shaft which is connected to said tensioning wheel, said lever element is connected to said opening means by a gear arrangement, said gear arrangement includes a drive wheel which is connected to said lever element and said rotation shaft, said drive wheel rotationally connected to a driven wheel which is connected to a drive shaft.

9. An apparatus for tensioning and securing together a packing strap comprising a tensioning wheel, a swivel lever, pressure plate means which cooperates with said tensioning wheel for selectively providing tension to the ends of said packing strap, closing means for pressing together and securing together said ends of said packing strap, and opening means for lifting said closing means from said ends of said packing strap and releasing the tension on said ends by said pressure plate means, said swivel lever connected to said tensioning wheel by connector means for selectively rotating said tensioning wheel, and said swivel lever includes an actuator for selectively engaging said opening means on an actuator area wherein said actuator upon engagement with said opening means at said actuation area causing said opening means to disengage said closing means and to disengage said pressure plate means from said ends of said packing strap, wherein said actuator includes a stop pin connected to said swivel lever, and said actuation area is positioned on a lever element which is rotatably coupled to a rotation shaft which is connected to said tensioning wheel, wherein said stop pin is connected to a pawl, said pawl axially movable in said swivel lever for selectively engaging said rotation shaft of said tensioning wheel, wherein said lever element is connected to said opening means by a gear arrangement, said gear arrangement includes a drive wheel which is connected to said lever element and said rotation shaft, said drive wheel rotationally connected to a driven wheel which is connected to a drive shaft.

10. An apparatus for tensioning and securing together a packing strap comprising a tensioning wheel, a swivel lever, pressure plate means which cooperates with said tensioning wheel for selectively providing tension to the ends of said packing strap, closing means for pressing together and securing together said ends of said packing strap, and opening means for lifting said closing means from said ends of said packing strap and releasing the tension on said ends by said pressure plate means, said swivel lever connected to said tensioning wheel by connector means for selectively rotating said tensioning wheel, and said swivel lever includes an actuator for selectively engaging said opening means on an actuator area wherein said actuator upon engagement with said opening means at said actuation area causing said opening means to disengage said closing means and to disengage said pressure plate means from said ends of said packing strap, wherein said actuator includes a stop pin connected to said swivel lever, and said actuation area is positioned on a lever element which is rotatably coupled to a rotation shaft which is connected to said tensioning wheel, wherein said stop pin is connected to a pawl, said pawl axially movable in said swivel lever for selectively engaging said rotation shaft of said tensioning wheel, wherein said swivel lever including a ratchet wheel which engages said rotation shaft, and said pawl in selective engagement with said ratchet wheel for controllably rotating said rotation shaft upon movement of said swivel lever, wherein said lever element is connected to said opening means by a gear arrangement, said gear arrangement includes a drive wheel which is connected to said lever element and said rotation shaft, said drive wheel rotationally connected to a driven wheel which is connected to a drive shaft.

11. An apparatus as defined in claim 8, wherein said drive wheel is connected to said drive shaft by an arrangement selected from the group consisting of an endless drive chain and a transmission gear wheel.

12. An apparatus as defined in claim 9, wherein said drive wheel is connected to said drive shaft by an arrangement selected from the group consisting of an endless drive chain and a transmission gear wheel.

13. An apparatus as defined in claim 12, wherein said drive wheel is connected to said drive shaft by an arrangement selected from the group consisting of an endless drive chain and a transmission gear wheel.

14. An apparatus for tensioning and securing together a packing strap comprising a tensioning wheel, a swivel lever, pressure plate means which cooperates with said tensioning wheel for selectively providing tension to the ends of said packing strap, closing means for pressing together and securing together said ends of said packing strap, and opening means for lifting said closing means from said ends of said packing strap and releasing the tension on said ends by said pressure plate means, said swivel lever connected to said tensioning wheel by connector means for selectively rotating said tensioning wheel, and said swivel lever includes an actuator for selectively engaging said opening means on an actuator area wherein said actuator upon engagement with said opening means at said actuation area causing said opening means to disengage said closing means and to disengage said pressure plate means from said ends of said packing strap, said opening means including a swivel body connected to a drive shaft, said swivel body including a stop element and a pressure body, said stop element formed to selectively engage said pressure plate means for disengaging said pressure plate means from said tensioning wheel, said pressure body formed to selectively engage said closing means for disengaging said closing means from said ends of said packing straps, said closing means including an actuating tappet which is selectively contacted by said pressure body.

15. An apparatus as defined in claim 8, wherein said opening means including a swivel body connected to said drive shaft, said swivel body including a stop element and a pressure body, said stop element formed to selectively engage said pressure plate means for disengaging said pressure plate means from said tensioning wheel, said pressure body formed to selectively engage said closing means for disengaging said closing means from said ends of said packing straps, said closing means including an actuating tappet which is selectively contacted by said pressure body.

16. An apparatus as defined in claim 9, wherein said opening means including a swivel body connected to said drive shaft, said swivel body including a stop element and a pressure body, said stop element formed to selectively engage said pressure plate means for disengaging said pressure plate means from said tensioning wheel, said pressure body formed to selectively engage said closing means for disengaging said closing means from said ends of said packing straps, said closing means including an actuating tappet which is selectively contacted by said pressure body.

17. An apparatus as defined in claim 10, wherein said opening means including a swivel body connected to said drive shaft, said swivel body including a stop element and a pressure body, said stop element formed to selectively engage said pressure plate means for disengaging said pressure plate means from said tensioning wheel, said pressure body formed to at least selectively engage said closing means for disengaging said closing means from said ends of said packing straps, said closing means including an actuating tappet which is selectively contacted by said pressure body.

18. An apparatus as defined in claim 11, wherein said opening means including a swivel body connected to said drive shaft, said swivel body including a stop element and a pressure body, said stop element formed to selectively engage said pressure plate means for disengaging said pressure plate means from said tensioning wheel, said pressure body formed to selectively engage said closing means for disengaging said closing means from said ends of said packing straps, said closing means including an actuating tappet which is selectively contacted by said pressure body.

19. An apparatus as defined in claim 12, wherein said opening means including a swivel body connected to said drive shaft, said swivel body including a stop element and a pressure body, said stop element formed to selectively engage said pressure plate means for disengaging said pressure plate means from said tensioning wheel, said pressure body formed to selectively engage said closing means for disengaging said closing means from said ends of said packing straps, said closing means including an actuating tappet which is selectively contacted by said pressure body.

20. An apparatus as defined in claim 13, wherein said opening means including a swivel body connected to said drive shaft, said swivel body including a stop element and a pressure body, said stop element formed to selectively engage said pressure plate means for disengaging said pressure plate means from said tensioning wheel, said pressure body formed to selectively engage said closing means for disengaging said closing means from said ends of said packing straps, said closing means including an actuating tappet which is selectively contacted by said pressure body.

21. An apparatus as defined in claim 14, wherein said pressure body is connected to said swivel body by a damping arrangement.

22. An apparatus as defined in claim 14, wherein said actuating tappet is biased by a spring for engagement with said pressure body.

23. An apparatus as defined in claim 21, wherein said actuating tappet is biased by a spring for engagement with said pressure body.

24. An apparatus as defined in claim 1, wherein said closing means including a friction cheek and switch means for moving said friction cheek into engagement with said ends of said packing straps and activating a movement means for moving said friction cheek in frictional engagement with said ends of said packing straps.

25. An apparatus as defined in claim 24, wherein said movement means includes an electric motor.

* * * * *